US008523037B2

(12) United States Patent
Segura

(10) Patent No.: US 8,523,037 B2
(45) Date of Patent: Sep. 3, 2013

(54) CONTROL VALVE ASSEMBLY FOR FASTENER-DRIVING TOOL

(75) Inventor: Ricardo Segura, Lake in the Hills, IL (US)

(73) Assignee: Illinois Tool Works Inc., Glenview, IL (US)

( * ) Notice: Subject to any disclaimer, the term of this patent is extended or adjusted under 35 U.S.C. 154(b) by 498 days.

(21) Appl. No.: 12/226,924

(22) PCT Filed: May 1, 2007

(86) PCT No.: PCT/US2007/010698
§ 371 (c)(1),
(2), (4) Date: Mar. 4, 2009

(87) PCT Pub. No.: WO2007/142766
PCT Pub. Date: Dec. 13, 2007

(65) Prior Publication Data

US 2009/0218383 A1 Sep. 3, 2009

Related U.S. Application Data

(60) Provisional application No. 60/809,930, filed on Jun. 1, 2006.

(51) Int. Cl.
*B25C 1/04* (2006.01)

(52) U.S. Cl.
USPC ..... 227/130; 227/107

(58) Field of Classification Search
USPC ..... 227/130, 107
See application file for complete search history.

(56) References Cited

U.S. PATENT DOCUMENTS

| | | | | | |
|---|---|---|---|---|---|
| 2,212,339 | A * | 8/1940 | Cullen | 227/146 |
| 3,099,012 | A * | 7/1963 | Wandel | 227/123 |
| 3,106,136 | A * | 10/1963 | Langas et al. | 91/417 A |
| 3,170,487 | A * | 2/1965 | Juilfs et al. | 137/625.6 |
| 3,194,324 | A * | 7/1965 | Langas | 173/2 |
| 3,208,353 | A * | 9/1965 | Wandel | 91/52 |
| 3,568,909 | A * | 3/1971 | Perkins | 227/130 |
| 3,580,455 | A * | 5/1971 | Cast et al. | 227/8 |
| 3,673,922 | A * | 7/1972 | Doyle | 91/422 |
| 3,771,710 | A * | 11/1973 | Perkins et al. | 227/130 |
| 3,815,475 | A * | 6/1974 | Howard et al. | 91/399 |
| 3,945,551 | A * | 3/1976 | Sato et al. | 227/136 |
| 3,952,398 | A * | 4/1976 | Haytayan | 29/432 |
| 4,509,668 | A * | 4/1985 | Klaus et al. | 227/8 |
| 4,784,308 | A * | 11/1988 | Novak et al. | 227/130 |
| 4,867,366 | A * | 9/1989 | Kleinholz | 227/66 |
| 5,083,694 | A * | 1/1992 | Lemos | 227/8 |
| 5,687,897 | A * | 11/1997 | Fa et al. | 227/8 |
| 5,806,748 | A * | 9/1998 | Lee | 227/130 |
| 5,836,501 | A * | 11/1998 | Lai | 227/8 |
| 6,056,070 | A * | 5/2000 | Shinohara et al. | 173/128 |
| 6,079,605 | A * | 6/2000 | Braun et al. | 227/130 |
| 6,431,425 | B1 * | 8/2002 | Moorman et al. | 227/8 |
| 7,475,800 | B2 * | 1/2009 | Liang | 227/130 |
| 2002/0175200 | A1 * | 11/2002 | Liu | 227/130 |
| 2009/0314818 | A1 * | 12/2009 | Segura | 227/8 |

* cited by examiner

*Primary Examiner* — Brian D Nash
(74) *Attorney, Agent, or Firm* — Law Offices of Steven W. Weinrieb

(57) ABSTRACT

A new and improved trigger-actuated control valve assembly for use within a fastener-driving tool wherein upper and lower control valve housing members are adapted to be fixedly mated together by a bayonet-type connection defined by a pair of diametrically opposed lug members disposed upon the lower valve housing member and a ledge structure defined upon the upper valve housing member. In addition, the trigger-actuated control valve assembly is fluidically connected to the upper control air chamber of the fastener-driving tool by externally disposed air passages which do not comprise complex compound angles and are therefore able to be integrally cast within the fastener-driving tool housing along with a cavity for housing the new and improved trigger-actuated control valve assembly.

14 Claims, 6 Drawing Sheets

CONTROL VALVE ASSEMBLY FOR FASTENER-DRIVING TOOL

CROSS REFERENCE TO RELATED PATENT APPLICATIONS

This patent application is related to, and based upon, U.S. Provisional Patent Application Ser. No. 60/809,930 which was filed on Jun. 1, 2006, the priority benefits of which are hereby claimed. This patent application is also related to, and based upon, PCT Patent Application PCT/US2007/010698 which was filed on May 1, 2007 and WO 2007/142766 which was published on Dec. 13, 2007, the priority benefits of which are also hereby claimed.

FIELD OF THE INVENTION

The present invention relates generally to fastener-driving tools, and more particularly to a new and improved trigger-actuated eccentric control valve assembly for use in a fastener-driving tool wherein a spring-biased, trigger-actuated control valve member is disposed internally within upper and lower valve spool or valve housing members of the trigger-actuated eccentric control valve assembly. The upper and lower valve spool or valve housing members are adapted to be fixedly mated together by means of a bayonet-type connection, defined by means of a pair of diametrically opposed dovetail lug members disposed upon the lower valve spool or valve housing member and a gripping ledge structure defined upon the upper valve spool or valve housing member, as a result of the upper and lower valve spool or valve housing members being angularly rotated a predetermined amount with respect to each other. In this manner, the trigger-actuated eccentric control valve assembly can be pre-assembled together prior to its disposition and assembly within the fastener-driving tool housing. In addition, the trigger-actuated eccentric control valve assembly of the present invention is fluidically connected to the upper control air chamber of the fastener-driving tool by means of externally disposed air passages which are cast within the fastener-driving tool housing in such a manner that the air passages need not be machined according to complex compound angle orientations or arrangements.

BACKGROUND OF THE INVENTION

Trigger-actuated control valve assemblies are conventionally utilized within fastener-driving tools so as to control the flow of air into and out from an upper air chamber which is disposed above the fastener-driving tool cylinder within which the fastener-driving piston, and the driver blade attached thereto, are movably disposed in order to drive and discharge fasteners through and out of the fastener-driving tool. During a typical fastener-driving tool firing cycle or operation, the upper air chamber is adapted to be charged with, and vented or exhausted of, air in accordance with the various stages of operation accompanying a fastener-driving cycle. An example of such a fastener-driving tool, within which such a trigger-actuated control valve assembly is disposed and utilized for controlling the flow of air into and out from the upper air chamber, is disclosed in U.S. Pat. No. 4,404,894 which issued to Oesterle on Sep. 20, 1983. In addition, as is also disclosed within FIG. 1, a conventional, PRIOR ART fastener-driving tool, generally indicated by the reference character 10, has a trigger-actuated control valve assembly 12 disposed therein, and the trigger-actuated control valve assembly 12 has an air passage 14 fluidically connected thereto, and incorporated within the fastener-driving tool housing 13, for controlling the air to be delivered to or charged into the upper air chamber, or for controlling the air to be vented or exhausted from the upper air chamber. More particularly, it is seen that the air passage 14 comprises a first, vertically oriented passageway or section 16 and, in order to achieve the fluidic communication between the first, vertically oriented passageway or section 16 and the trigger-actuated control valve assembly 12, it is necessary, to incorporate a second, angularly oriented or inclined passageway or section 18 within the fastener-driving tool housing 13. It is noted that a similarly structured air passage is disclosed within the aforenoted patent to Oesterle, however, in either case, it is extremely difficult to accurately machine such compound angle passages, particularly the angularly oriented or inclined passageways or sections thereof. Still further, such compound angle passages cannot be formed by means of a casting process in view of the fact that once the fastener-driving tool housing is fabricated from the cast material, which thereby forms the solid portions of the housing, around, in effect, mandrel members disposed within the mold structure for forming the aforenoted passages, there would be no way to extract or remove the mandrel members or structures from the cast housing structure.

Continuing further, it is additionally noted that, in connection with the fabrication of conventional, PRIOR ART trigger-actuated control valve assemblies, the trigger-actuated control valve assemblies usually comprise a multiplicity of component parts which therefore entails a substantially large inventory of component parts as well as a significant amount of time to assemble the component parts together. For example, the trigger-actuated control valve assembly comprises a housing which is usually fabricated as a two-part structure in order to be able to insert the actual trigger-actuated control valve mechanism internally therewithin, however, in accordance with a first type of trigger-actuated control valve assembly structure, separate fastener components, in the form of pins, rings, or the like, are required to fixedly secure the housing halves or complementary housing structures together. In accordance with a second type of trigger-actuated control valve assembly housing structure, the housing halves or complementary housing structures respectively comprise fastener components integrally formed thereon which have unique configurations, forms, contours, or the like that mandate or require the housing halves or complementary housing structures to be assembled together in a predetermined orientation or manner. Not only is the assembly or mating together of the housing halves or complementary housing structures therefore quite tedious, but in addition, the fabrication of such housing halves or complementary housing structures requires complex injection molding tooling.

A need therefore exists in the art for a new and improved trigger-actuated control valve assembly, for use within a fastener-driving tool, wherein the trigger-actuated control valve assembly can be fluidically connected to the upper control air chamber of the fastener-driving tool by means of externally disposed air passages which do not comprise compound angles and which can therefore be cast within the fastener-driving tool housing so as to effectively eliminate the need for machining such air passages in accordance with, or at, complex compound angle arrangements, wherein the trigger-actuated control valve assembly comprises two mating housing sections which can be readily assembled together in a relatively quick and easy manner without the need for separate fastener components to hold the assembled housing sections together, wherein the trigger-actuated control valve assembly comprises two mating housing sections which comprise interengaging fasteners which are integrally formed thereon and which are relatively easy to fabricate, and wherein the interengaging fasteners of the two mating housing sections of the trigger-actuated control valve assembly do not need to be necessarily oriented in a particular manner.

SUMMARY OF THE INVENTION

The foregoing and other objectives are achieved in accordance with the teachings and principles of the present invention through the provision of a new and improved trigger-actuated control valve assembly for use within a fastener-driving tool wherein a spring-biased, trigger-actuated control valve member is disposed internally within upper and lower valve spool or valve housing members of the trigger-actuated eccentric control valve assembly. The upper and lower valve spool or valve housing members are adapted to be fixedly mated together by means of a bayonet-type connection, defined by means of a pair of diametrically opposed dovetail lug members disposed upon the lower valve spool or valve housing member and a gripping ledge structure defined upon the upper valve spool or valve housing member, as a result of the upper and lower valve spool or valve housing members being angularly rotated a predetermined amount with respect to each other. In this manner, the trigger-actuated control valve assembly can be pre-assembled together in a relatively quick and easy manner prior to its disposition and assembly within the fastener-driving tool housing. In addition, the trigger-actuated control valve assembly of the present invention is fluidically connected to the upper control air chamber of the fastener-driving tool by means of externally disposed air passages which do not comprise complex compound angles or orientations with respect to each other and are therefore able to be cast within the fastener-driving tool housing. Still further, the casting of the air passages within the fastener-driving tool housing permits at least one of the externally disposed air passages to have a substantially large length dimension which would not otherwise be possible to accurately achieve by means of machining or drilling operations in view of the unsupported length of the machining or drilling tools.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
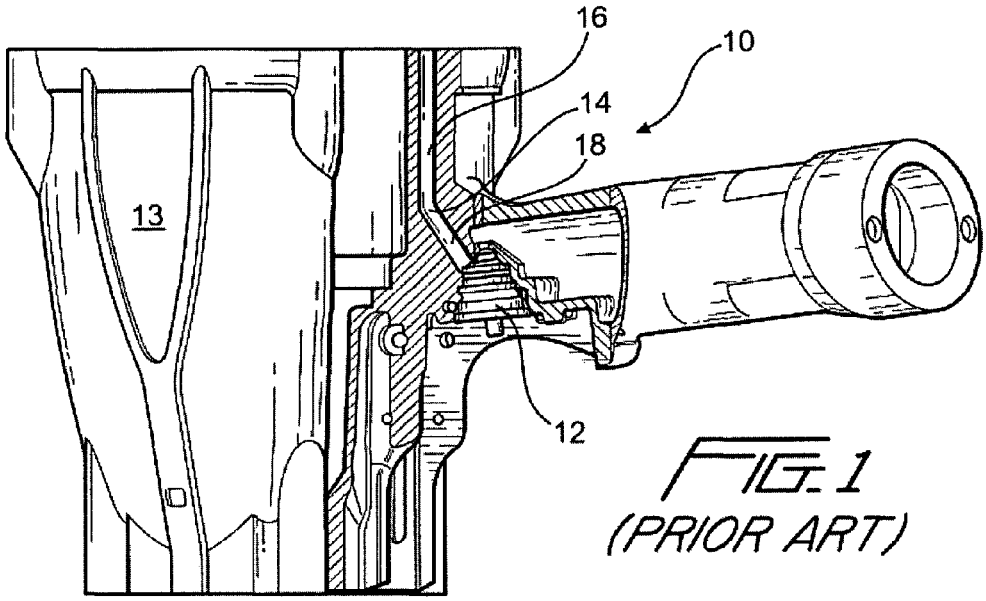
FIG. 1 (PRIOR ART)
FIG. 1 is a partial, cross-sectional view of a fastener-driving tool within which a conventional, PRIOR ART trigger-actuated control valve assembly is disposed, and wherein a substantially vertically oriented air passageway, having a compound angle configuration, is provided within the fastener-driving tool housing for fluidically connecting the trigger-actuated control valve assembly to the upper control air chamber of the fastener-driving tool.
Figure 2:
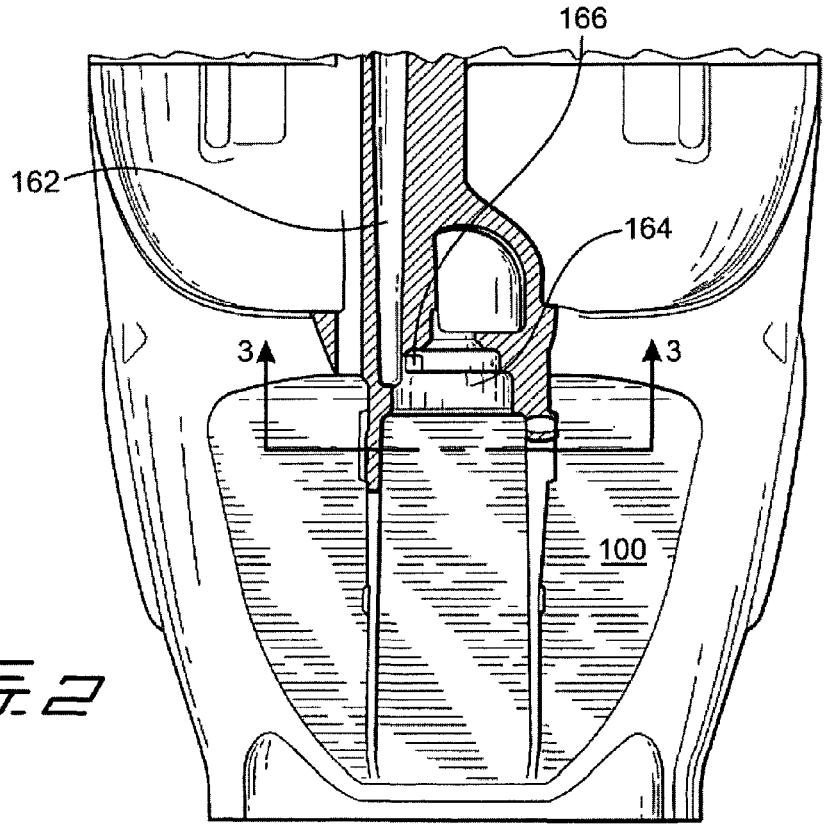
FIG. 2 is a cross-sectional view of a new and improved fastener-driving tool housing section having cast therein the cavity within which the new and improved trigger-actuated control valve assembly of the present invention is to be disposed, as well as the air passageways fluidically connecting the new and improved trigger-actuating control valve assembly to the upper control air chamber of the fastener-driving tool.
Figure 3:
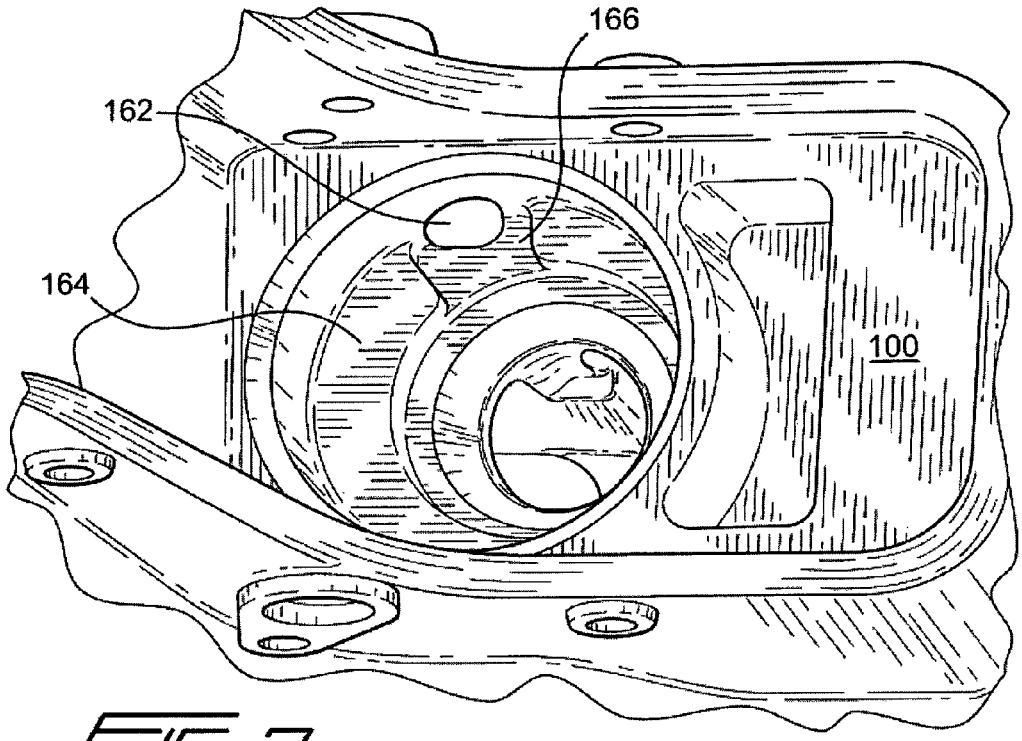
FIG. 3 is a cross-sectional view of the new and improved fastener-driving tool housing section as disclosed within FIG. 2 and as taken along the lines 3-3 of FIG. 2.
Figure 4:
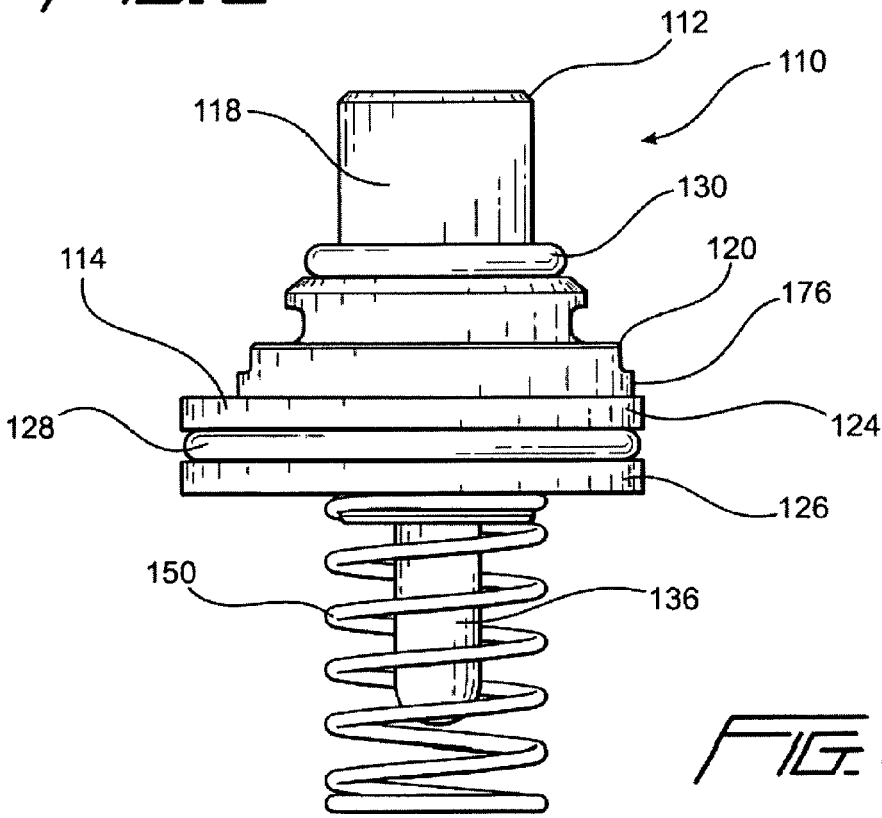
FIG. 4 is an enlarged side elevational view of the new and improved trigger-actuated control valve assembly constructed in accordance with the principles and teachings of the present invention and showing the cooperative parts thereof.
Figure 5:
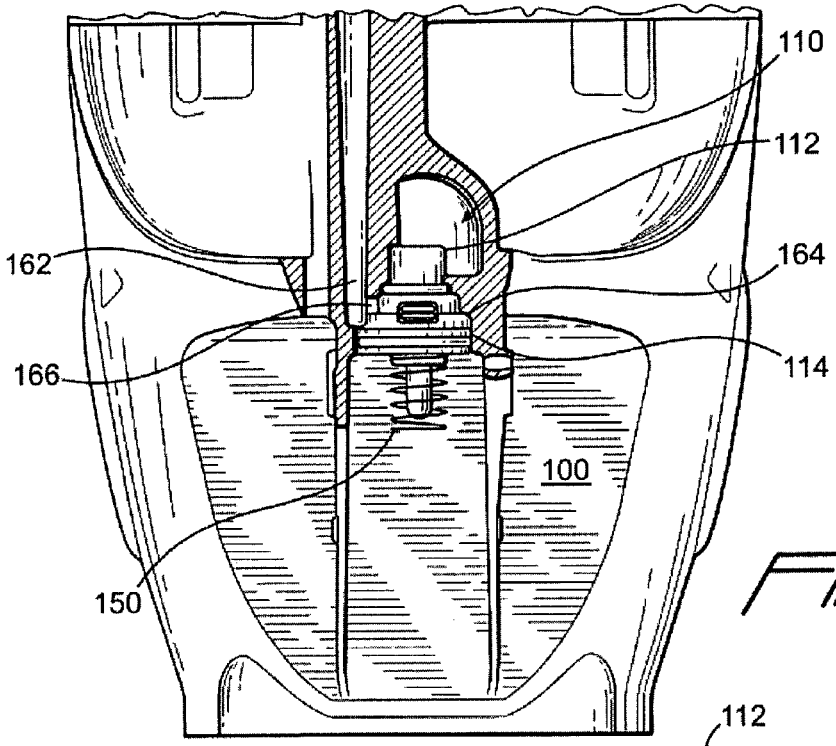
FIG. 5 is a cross-sectional view similar to that of FIG. 2 showing, however, the new and improved trigger-actuated control valve assembly of the present invention, as disclosed within FIG. 4, disposed within the valve assembly cavity cast within the new and improved fastener-driving tool housing section.

Referring now to the drawings, and more particularly to FIGS. 2-7 thereof, a new and improved trigger-actuated control valve assembly, constructed in accordance with the principles and teachings of the present invention and adapted for use within a fastener-driving tool which is partially illustrated by means of its new and improved housing structure 100, is disclosed and is generally indicated by the reference character 110. More particularly, it is seen that the new and improved trigger-actuated control valve assembly 110 comprises an upper valve spool or upper valve housing member 112, a lower valve spool or lower valve housing member 114, and a trigger-actuated control valve member 116 movably disposed within the upper and lower valve housing members 112,114. The upper valve housing member 112 is seen to have a stepped configuration comprising an upper substantially cylindrical portion 118 and a lower flanged portion 120, while the lower valve housing member 114 is seen to comprise a substantially cylindrical member wherein the external periphery thereof is provided with an annular recess 122 at an axially central position thereof whereby the external periphery of the lower valve housing member 114 is effectively divided into an upper annular section 124 and a lower annular section 126. A first lower annular O-ring sealing member 128 is disposed within the annular recess 122 of the lower valve housing member 114, and a second upper annular O-ring sealing member 130 is disposed around the external periphery of the upper valve housing member 112 at the annular shouldered intersection or junction defined between the upper cylindrical portion 118 and the lower flanged portion 120 of the upper valve housing member 112.

Figure 7:
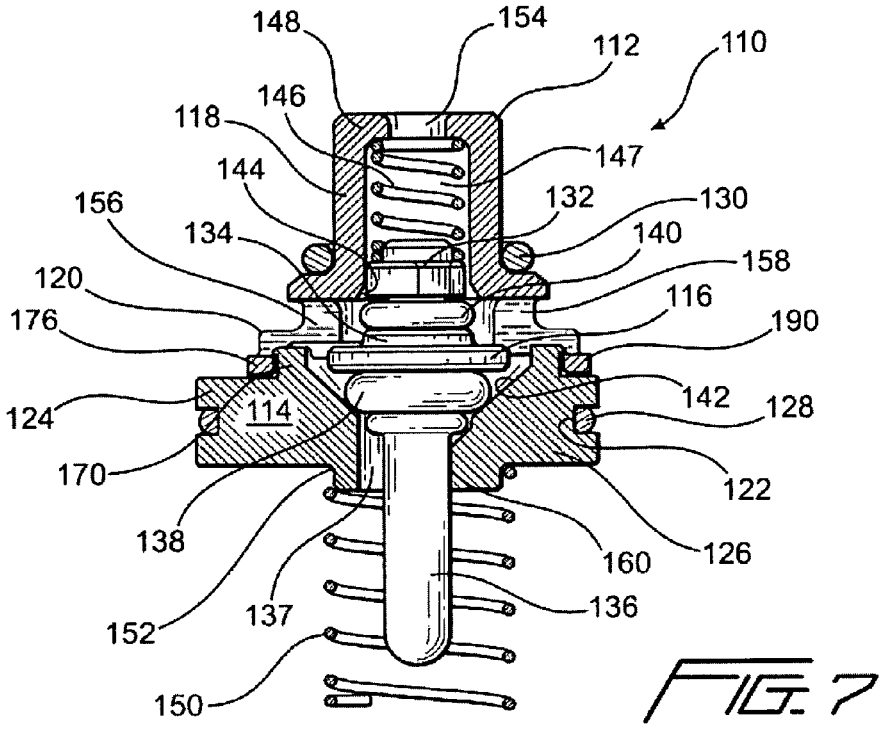
FIG. 7 is an enlarged vertical cross-sectional view of the new and improved trigger-actuated control valve assembly as disclosed within FIG. 4.

Continuing further, and as can best be appreciated from FIG. 7, it is seen that the trigger-actuated control valve member 116 comprises an upper head portion 132 having a stepped configuration, an intermediate body portion 134, and a lower downwardly projecting valve stem portion 136 which extends downwardly through a bore 137 defined within the lower valve housing member 114. In addition, a third annular O-ring sealing member 138 is disposed within an annular recessed portion defined between the intermediate body portion 134 and the lower downwardly projecting valve stem portion 136 of the trigger-actuated control valve member 116, while a fourth annular O-ring sealing member 140 is likewise disposed within an annular recessed portion defined between the upper head portion 132 and the intermediate body portion 134 of the trigger-actuated control valve member 116. Concomitantly therewith, a first, lower annular valve seat 142 is effectively defined upon an internal, substantially frustoconically configured portion of the lower valve housing member 114, while a second, upper annular valve seat 144 is effectively defined upon an internal portion of the upper valve housing member 112 at the intersection or junction of the upper cylindrical portion 118 of the upper valve housing member 112 and the lower flanged portion 120 of the upper valve housing member 112.

In addition, it is seen that a first coil spring member 146 is disposed within an internal bore 147 defined within the upper cylindrical portion 118 of the upper valve housing member 112 such that the upper end portion of the first coil spring member 146 is engaged with and seated upon an internal end wall portion of an upper end cap portion 148 of the upper valve housing member 112, while the lower end portion of the first coil spring member 146 is engaged with and seated upon the upper head portion 132 of the trigger-actuated control valve member 116. In this manner, the trigger-actuated control valve member 116 will normally be biased downwardly by means of the first coil spring member 146 such that the third annular O-ring sealing member 138 will normally be seated upon the first annular lower valve seat 142. Still further, a second coil spring member 150 is disposed beneath the lower valve housing member 114 such that an upper end portion of the second coil spring member 150 is engaged with and seated upon an underlying shouldered portion 152 defined upon an undersurface portion of the lower valve housing member 114 while a lower end portion of the second coil spring member 150 is adapted to be disposed in contact with an actuation lever, not shown, which is a component part of the fastener-driving tool trigger assembly. It is further seen that the upper end cap portion 148 of the upper valve housing member 112 has a through-bore 154 defined therein so as to be in fluidic communication with the bore 147 defined internally within the upper valve housing member 112, while diametrically opposed side wall portions of the lower flanged portion 120 of the upper valve housing member 112 are respectively provided with a pair of windows 156,158.

Accordingly, it can be appreciated that when the trigger member, not shown, of the fastener-driving tool trigger assembly is not actuated or depressed such that the actuation lever, also not shown, of the fastener-driving tool trigger assembly is not actuated or moved upwardly, the trigger-actuated control valve member 116 will be disposed at its normal, lowered position, as illustrated within FIG. 7, whereby the third annular O-ring sealing member 138 will be disposed upon its valve seat 142 while the fourth annular O-ring sealing member 140 will be unseated or removed from its valve seat 144. Therefore, at this point in time, pressurized air from a suitable air source, not shown, will enter the throughbore 154 defined within the upper end cap portion 148 of the upper valve housing member 112, will traverse internal bore 147 defined within the upper valve housing member 112, and will be able to exit through the pair of diametrically opposed windows 156,158 so as to be conducted toward the upper control air chamber defined within the fastener-driving tool at a location above the fastener-driving tool actuating piston and driver blade assembly, not shown.

Figure 8:
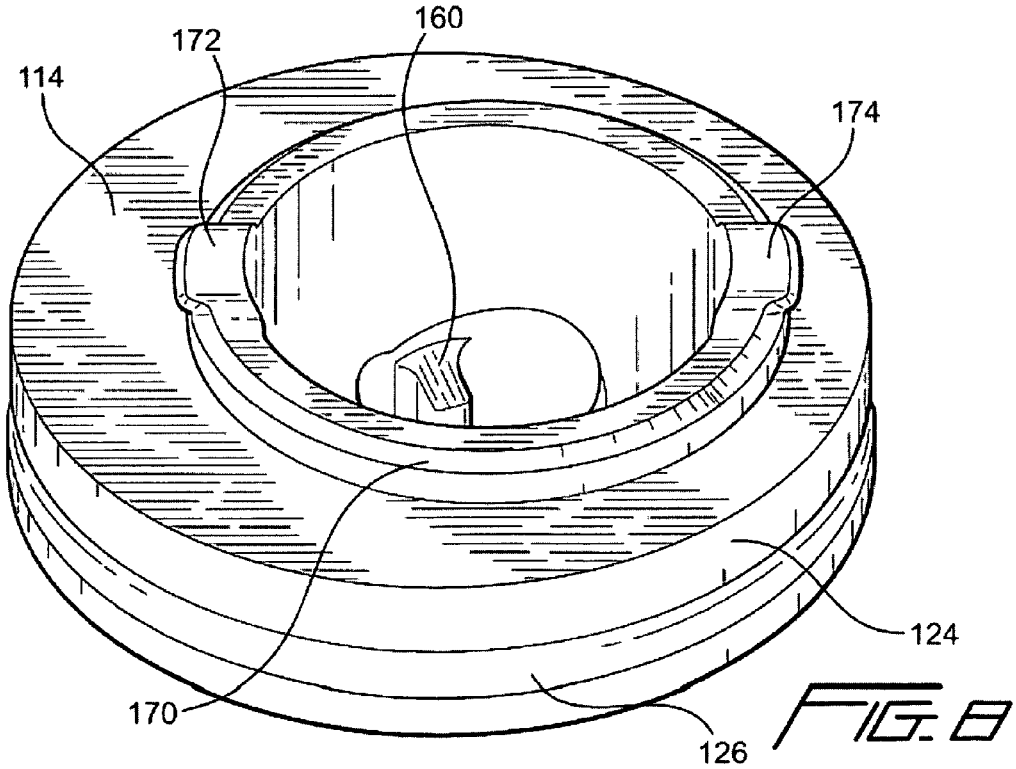
FIG. 8 is an enlarged, top perspective view of the lower valve spool or valve housing member of the new and improved trigger-actuated control valve assembly, as disclosed within FIG. 4, illustrating the pair of diametrically opposed lug members which form part of the bayonet-type connection defined between the upper and lower valve spool or valve housing members of the new and improved trigger-actuated control valve assembly.

Alternatively, when the trigger member, not shown, of the fastener-driving tool trigger assembly is actuated or depressed such that the actuation lever, also not shown, of the fastener-driving tool trigger assembly is now actuated or moved upwardly so as to engage the lower end portion of the downwardly projecting valve stem portion 136 of the trigger-actuated control valve member 116, the trigger-actuated control valve member 116 will be moved upwardly whereby the fourth annular O-ring sealing member 140 will now be engaged with and seated upon its valve seat 144 while the third annular O-ring sealing member 138 will now be disengaged or un-seated from its valve seat 142. Accordingly, at this point in time, pressurized air from the air source, not shown, cannot pass by the fourth annular O-ring sealing member 140, and concomitantly, the air present within the upper control air chamber of the fastener-driving tool at the location above the fastener-driving tool actuating piston and the driver blade assembly, not shown, will be able to be exhausted through the pair of diametrically opposed windows 156,158 and the throughbore 137 defined within the lower valve housing member 114. It is to be additionally noted that a plurality of circumferentially or angularly spaced lug members 160, such as, for example, three lug members 160, although only one of them can be seen in FIGS. 7 and 8, are provided upon the internal peripheral wall surface portion of the lower valve housing member 114, which effectively defines the throughbore 137, so as to effectively serve as guide members for the vertical movement of the downwardly projecting valve stem portion 136 of the trigger-actuated control valve member 116 during its movements between its raised and lowered positions.

Continuing still further, the new and improved trigger-actuated control valve assembly 110 of the present invention comprises an eccentric structure in that not only does the lower valve housing member 114 having a larger diametrical extent than that of the upper valve housing member 112, but, as can best be appreciated from FIGS. 4, 5, 7, and 12, the lower valve housing member 114 is disposed in an offset or eccentric manner with respect to the upper valve housing member 112. The reason for this is that, as can best be appreciated still further from FIGS. 2 and 5, when the new and improved trigger-actuated control valve assembly 110 is disposed and accommodated within the new and improved housing structure 100 of the fastener-driving tool, the offset or eccentric disposition of the lower valve housing member 114 with respect to the upper valve housing member 112 effectively creates a space within which the lower end portion of a first vertically oriented, longitudinally tapered fluid passageway 162 may effectively be defined and accommodated. The new and improved housing structure 100 of the fastener-driving tool is also provided with a trigger-actuated control valve assembly cavity 164 within which the new and improved trigger-actuated control valve assembly 110 of the present invention may be housed and accommodated, and as can best be seen from FIGS. 2, 5, and 6, a second, substantially horizontally or radially oriented fluid passageway 166 which necessarily fluidically connects the first vertically oriented fluid passageway 162 to the trigger-actuated control valve assembly cavity 164 with proper fluid flow parameters. In other words, a substantially horizontally oriented fluid port or passage defined by means of the second, substantially horizontally or radially oriented fluid passageway 166 is needed to fluidically connect the first vertically oriented fluid passageway 162 with the trigger-actuated control valve assembly cavity 164.

In accordance with the principles and teachings of the present invention, it is to be appreciated that in view of the foregoing structure comprising the various fluid passageways and cavity 162,164,166, no complex or compound angles are incorporated within such fluid structures whereby all of such structural components can be integrally cast within the new and improved housing structure 100 of the fastener-driving tool as opposed to being drilled or machined with the inherent drawbacks as has been noted hereinbefore. In connection with the fluid flow of air within the aforenoted fluid passageways and cavity 162,164,166, it is also to be noted that the diametrical extent of the trigger-actuated control valve assembly cavity 164 is slightly larger than the external diametrical extent of that portion of the lower flanged portion 120 of the upper valve housing member 112, within which the windows 156,158 are defined so as to effectively define an annular space 168, as can best be seen and appreciated from FIG. 6, and in this manner, incoming air from the external air source, not shown, can be conducted through the windows 156,158, into the annular space 168, into the second fluid passageway 166, and upwardly within the fluid passageway 162 to the upper control air chamber of the fastener-driving tool so as to charge the upper control air chamber as desired and required, or alternatively, air to be exhausted from the upper control air chamber of the fastener-driving tool can be conducted downwardly through the first vertically oriented passageway 162, through the second horizontally oriented passageway 166, into the annular space 168, and through the windows 156,158.

It is to be lastly noted in connection with the eccentric structure comprising the new and improved trigger-actuated control valve assembly 110 of the present invention that the same need not necessarily be characterized by means of its eccentric structure, but to the contrary, it is possible that the upper and lower valve housing members 112,114 may be concentrically disposed with respect to each other except that the lower valve housing member 114 would still have to have a diametrical extent which would be larger than that of the upper valve housing member 112, and that the trigger-actuated control valve assembly cavity 164 would have a similarly contoured configuration. In fact, the diametrical extent of the lower valve housing member 114 would have to be greater than that of the eccentrically mounted or disposed lower valve housing member 114, but in any case, the lower end portion of the first vertically oriented fluid passageway 162, as well as the second horizontally or radially oriented fluid passageway 166, would still be able to be accommodated and cast within the new and improved housing structure 100 of the fastener-driving tool. A potentially slight drawback, however, might present itself in the form of requiring a slightly larger housing structure 100, and therefore a slightly larger fastener-driving tool, in order to effectively enlarge the trigger-actuated control valve assembly cavity 164, so as to accommodate the enlarged lower valve housing member 114, while preserving predetermined wall thickness dimensions within those parts of the housing structure 100 in which, for example, the trigger-actuated control valve assembly cavity 164 is formed and defined.

Figure 9:
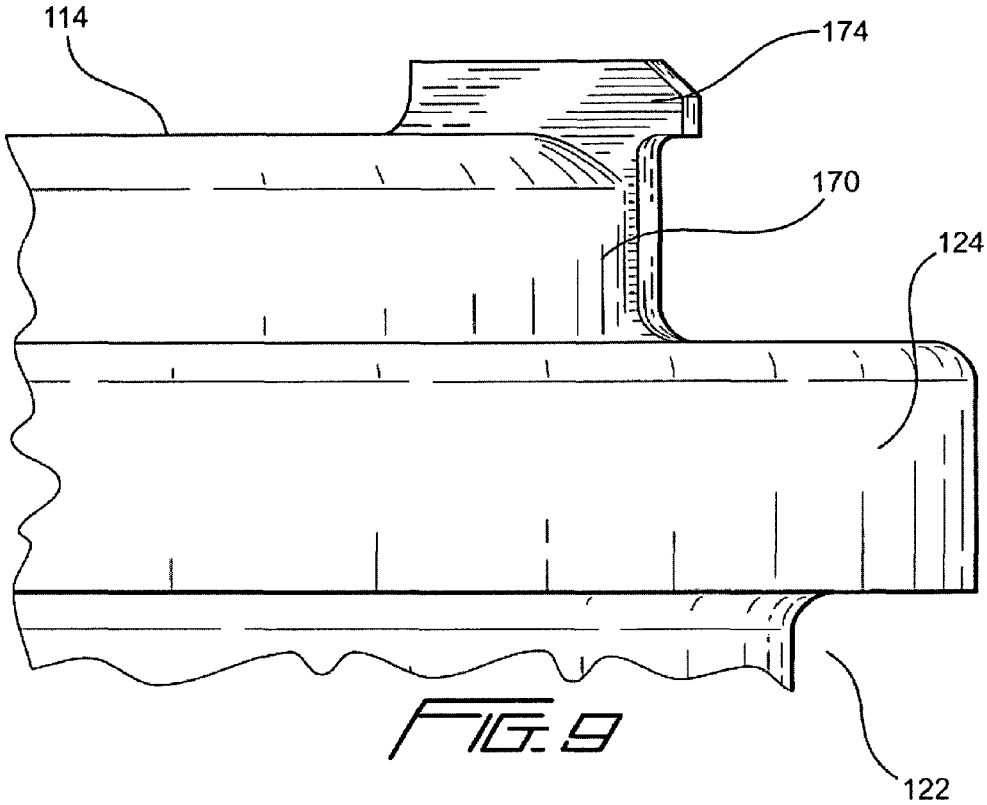
FIG. 9 is a partial, side elevational view of the lower valve spool or valve housing member, of the new and improved trigger-actuated control valve assembly, as disclosed within FIG. 8, showing the details of one of the diametrically opposed lug members which form part of the bayonet-type connection defined between the upper and lower valve spool or valve housing members of the new and improved trigger-actuated control valve assembly.
Figure 10:
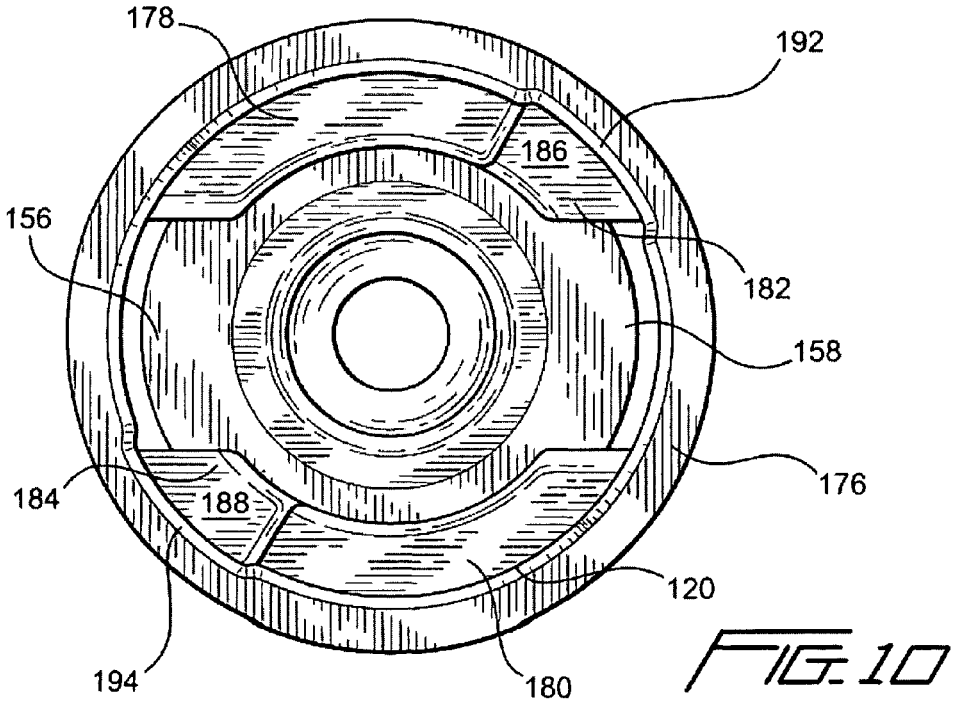
FIG. 10 is a bottom plan view of the upper valve spool or valve housing member of the new and improved trigger-actuated control valve assembly as constructed in accordance with the principles and teachings of the present invention.
Figure 11:
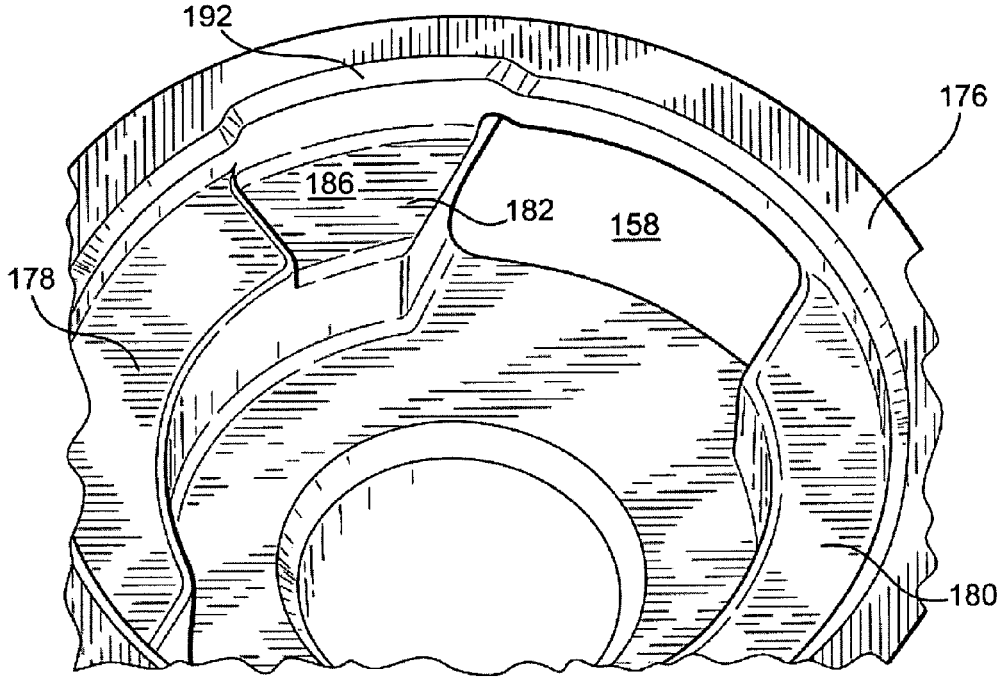
FIG. 11 is an enlarged bottom perspective view of the upper valve spool or valve housing member of the new and improved trigger-actuated control valve assembly, as disclosed within FIG. 10, showing the details of the air flow windows formed within the upper valve spool or valve housing member as well as the ledge portion of the upper valve spool or valve housing member for cooperating with the diametrically opposed lug members forming the bayonet-type connection between the upper and lower valve spool or valve housing members of the trigger-actuated control valve assembly.

It will of course be recalled that the new and improved trigger-actuated control valve assembly 110 comprises the upper valve spool or upper valve housing member 112 and the lower valve spool or lower valve housing member 114, and that such valve spools or valve housing members 112,114 are adapted to be fixedly secured together. Accordingly, with reference lastly being made to FIGS. 7-12, the unique and novel manner in which the valve spool or valve housing members 112,114 can in fact be fixedly, yet removably, secured together will now be described. More particularly, as can best be seen and appreciated from FIGS. 7-9, an upstanding annular flange member 170 is disposed atop the upper surface portion of the upper annular section 124 of the lower valve housing member 114, and a pair of diametrically opposed, arcuately configured lug members 172,174 are fixedly disposed upon the upper surface portion of the annular flange member 170 so as to project radially outwardly therefrom by means of a predetermined extent. In a corresponding manner, as can best be seen in FIGS. 4, 7, and 10-12, the lower outer periphery of the upper valve spool or valve housing member 112 forms or defines an annular ledge member 176. In addition, a pair of diametrically opposed, arcuately configured blocks 178,180 are integrally formed with, and disposed internally of, the annular ledge member 176, and a pair of diametrically opposed, arcuately configured, upwardly recessed regions 182, 184 are respectively formed within end portions of the blocks 178,180.

Figure 6:
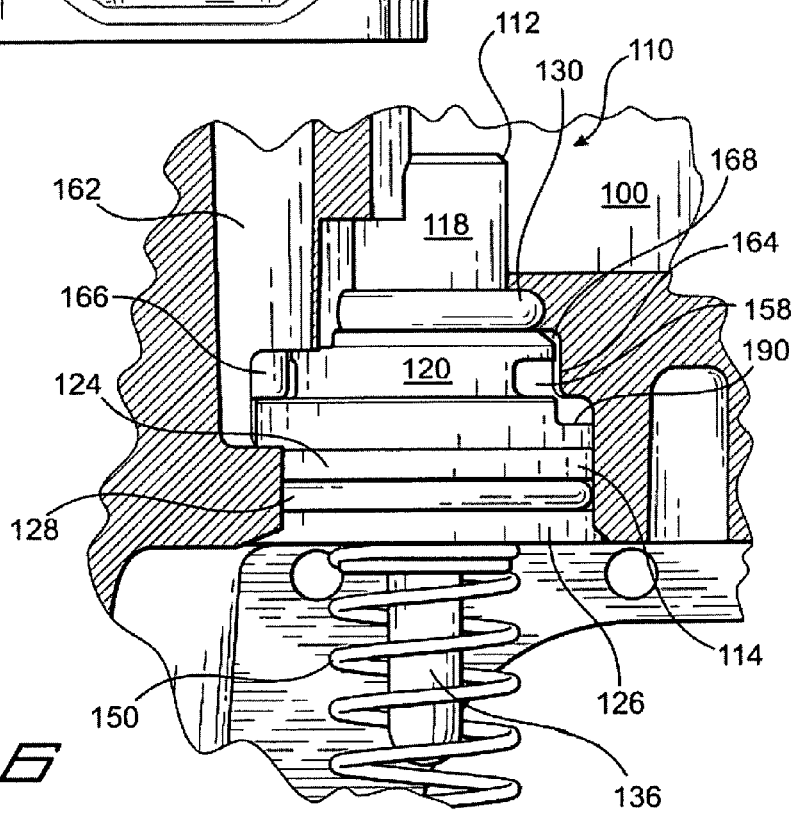
FIG. 6 is an enlarged cross-sectional view similar to that of FIG. 5 showing, however, in greater detail, the disposition of the new and improved trigger-actuated control valve assembly of the present invention as disposed within the cavity cast within the new and improved fastener-driving tool housing section.
Figure 12:
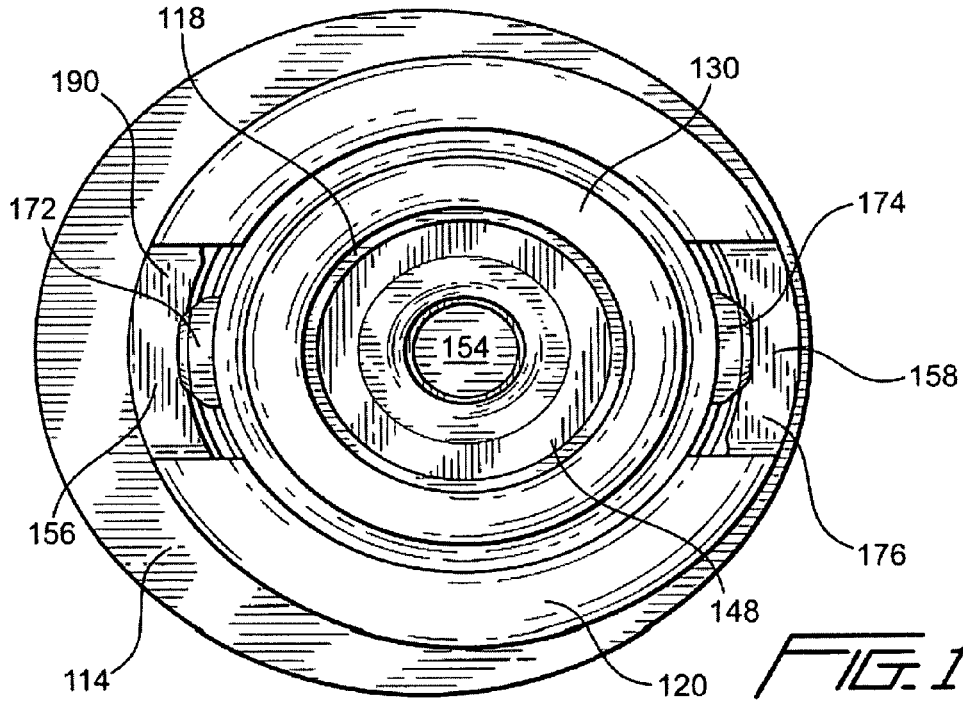
FIG. 12 is a top plan view of the new and improved trigger-actuated control valve assembly as disclosed within FIG. 4.

More particularly, it is to be appreciated that the undersurface portions 186,188 of the recessed regions 182, 184, as considered when the new and improved trigger-actuated control valve assembly 110 is disposed in its normal upright orientation as viewed, for example, in any one of the FIGS. 4-7, are disposed at an elevational level which is above the elevational level at which the upper surface portion 190 of the annular ledge member 176 is disposed as disclosed within FIGS. 6, 7, and 12, and therefore a space, for accommodating the pair of diametrically opposed lug members 172,174, is effectively formed therebetween. It is further seen that the inner periphery of the annular ledge member 176 is provided with a pair of diametrically opposed, radially outwardly extending cutout regions 192,194 which are respectively disposed at angular or circumferential positions which correspond to the angular or circumferential positions of the recessed regions 182,184. In this manner, when the upper and lower valve spool or valve housing members 112,114 are to be mated and assembled together, the trigger-actuated control valve member 116 is disposed within the upper and lower valve spool or valve housing members 112,114, and the upper and lower valve spool or valve housing members 112,114 are then axially pressed together so as to effectively press the trigger-actuated control valve member 116 against the biasing force of the first coil spring member 146 thereby axially compressing the first coil spring member 146.

At the same time, or substantially simultaneously therewith, the pair of oppositely disposed lug members 172, 174 are angularly or circumferentially aligned with and effectively inserted through the pair of diametrically opposed, radially outwardly extending cutout regions 192,194 so as to then be disposed within the recessed regions 182,184 and thereby effectively be disposed in engagement with the under-surface portions 186,188 of the recessed regions 182, 184, and subsequently, the upper valve spool or upper valve housing member 112 is rotated a predetermined angular amount in the clockwise direction with respect to the lower valve spool or valve housing member 114, as considered when looking in the axially downward direction as viewed, for example, within FIG. 12. Accordingly, the pair of oppositely disposed lug members 172,174, disposed upon the lower valve spool or valve housing member 114, will be disposed, for example, within the window regions 156,158 of the upper valve spool or upper valve housing member 112 such that the pair of oppositely disposed lug members 172, 174 of the lower valve spool or valve housing member 114 will effectively engage the upper surface portion 190 of the annular ledge member 176 of the upper valve spool or valve housing member 112 so as to effectively lock the upper and lower valve spool or valve housing members 112,114 together under the biasing force of the first coil spring member 146. As may readily be appreciated still further, the upper and lower valve spool or valve housing members 112,114 may be unlocked and separated or disengaged from each other as a result of, in effect, reverse disassembly procedures.

Thus, it may be seen that in accordance with the principles and teachings of the present invention, there has been disclosed a new and improved trigger-actuated control valve assembly for use within a fastener-driving tool wherein a spring-biased, trigger-actuated control valve member is initially disposed internally within upper and lower valve spool or valve housing members of the trigger-actuated control valve assembly. The upper and lower valve spool or valve housing members are adapted to be fixedly mated together by means of a bayonet-type connection, defined by means of a pair of diametrically opposed dovetail lug members disposed upon the lower valve spool or valve housing member, and a gripping ledge structure defined upon the upper valve spool or valve housing member, as a result of the upper and lower valve spool or valve housing members being angularly rotated a predetermined amount with respect to each other. In this manner, the trigger-actuated control valve assembly can be pre-assembled together in a relatively quick and easy manner prior to its disposition and assembly within the fastener-driving tool housing. In addition, the trigger-actuated control valve assembly of the present invention is fluidically connected to the upper control air chamber of the fastener-driving tool by means of externally disposed air passages which do not comprise complex compound angles or orientations with respect to each other and are therefore able to be integrally cast within the fastener-driving tool housing along with a cavity for housing or accommodating the new and improved trigger-actuated control valve assembly. Fabricating the new and improved trigger-actuated control valve assembly as an eccentric structure serves to compactly accommodate the aforenoted externally disposed air passages with respect to the aforenoted trigger-actuated control valve assembly cavity.

Obviously, many variations and modifications of the present invention are possible in light of the above teachings. It is therefore to be understood that within the scope of the appended claims, the present invention may be practiced otherwise than as specifically described herein.

What is claimed is:

1. A trigger-actuated control valve assembly for disposition within a fastener-driving tool housing, comprising:

a trigger-actuated control valve housing comprising an upper housing member and a lower housing member;

a first connector disposed upon a lower end portion of said upper housing member, and a second connector, disposed upon an upper end portion of said lower housing member, for interengaging said first connector of said upper housing member along a planar interface substantially defined between said lower end portion of said upper housing member and said upper end portion of said lower housing member such that said upper and lower housing members are disengageably connected together;

a trigger-actuated control valve member disposed within said trigger-actuated control valve housing;

a first valve seat defined upon said lower housing member of said trigger-actuated control valve housing;

a first seal member operatively associated with said first valve seat;

a second valve seat defined upon said upper housing member of said trigger-actuated control valve housing;

a second seal member operatively associated with said second valve seat;

a first bore defined within said upper housing member of said trigger-actuated control valve housing for permitting line pressure to enter said trigger-actuated control valve housing;

a second exhaust bore defined within said lower housing member of said trigger-actuated control valve housing and within which said trigger-actuated control valve member is disposed; and window structure, defined within said trigger-actuated control valve housing, for fluidic communication with a substantially horizontally oriented port defined within a first lower end portion of a substantially vertically oriented air passageway which is defined within the fastener-driving tool housing and which is fluidically connected at a second upper end portion thereof with a control air chamber of the fastener-driving tool, so as to conduct said line pressure to the control air chamber of the fastener-driving tool, from said first bore, said window structure, said substantially horizontally oriented port defined within said first lower end portion of said substantially vertically oriented air passageway, and said substantially vertically oriented air passageway in order to pressurize the control air chamber prior to firing of the fastener-driving tool as a result said first seal member being engaged with said first valve seat while said second seal member is disengaged from said second valve seat, and for permitting fluidic communication from the control air chamber of the fastener-driving tool to said second exhaust bore through said substantially vertically oriented air passageway, said first lower end portion of said substantially vertically oriented air passageway, said substantially horizontally oriented port, said window structure, and said exhaust bore within which said trigger-actuated control valve member is disposed, as a result said second seal member being disengaged from said second valve seat while said first seal member is engaged with said first valve seat, so as to permit firing of the fastener-driving tool.

2. The trigger-actuated control valve assembly as set forth in claim 1, wherein:

said lower housing member of said trigger-actuated control valve housing has a diametrical extent which is greater than the diametrical extent of said upper housing member of said trigger-actuated control valve housing so that an outer peripheral portion of said lower housing member of said trigger-actuated control valve housing extends radially beyond an outer peripheral portion of said upper housing member of said trigger-actuated control valve housing in order to define a space within which the first lower end portion of the substantially vertically oriented air passageway, and the substantially horizontally oriented port defined within the first lower end portion of the substantially vertically oriented air passageway, can be accommodated.

3. The trigger-actuated control valve assembly as set forth in claim 1, wherein:

said lower housing member of said trigger-actuated control valve housing is disposed in an eccentric manner with respect to said upper housing member of said trigger-actuated control valve housing.

4. The trigger-actuated control valve assembly as set forth in claim 1, wherein:

said first and second connectors for disengageably securing said upper and lower control valve housing members together comprises bayonet-type connectors.

5. The trigger-actuated control valve assembly as set forth in claim 4, wherein said bayonet-type fastening structure comprises:

a ledge member formed upon said upper control valve housing member; and a pair of diametrically opposed radially outwardly extending lugs disposed upon said lower control valve housing member for engaging said ledge member of said upper control valve housing member.

6. The trigger-actuated control valve assembly as set forth in claim 5, further comprising:

a pair of diametrically opposed radially outwardly extending cutouts, defined within said ledge member of said upper control valve housing member, for receiving said pair of diametrically opposed radially outwardly extending lugs of said lower control valve housing member and for permitting said upper and lower control valve housing members to subsequently be rotated a predetermined amount with respect to each other whereby said pair of diametrically opposed radially outwardly projecting lugs of said lower control valve housing member can engage said ledge member of said upper control valve housing member so as to disengageably secure said upper and lower control valve housing members together.

7. The trigger-actuated control valve assembly as set forth in claim 5, wherein:

said ledge member is formed upon a lower peripheral edge portion of said upper control valve housing member; and said pair of diametrically opposed radially outwardly extending lugs are disposed upon upper surface portions of said lower control valve housing member.

8. A fastener-driving tool, comprising:

a fastener-driving tool housing;

a trigger-actuated control valve housing comprising an upper housing member and a lower housing member;

a first connector disposed upon a lower end portion of said upper housing member, and a second connector, disposed upon an upper end portion of said lower housing member, for interengaging said first connector of said upper housing member along a planar interface substantially defined between said lower end portion of said upper housing member and said upper end portion of said lower housing member such that said upper and lower housing members are disengageably connected together;

a trigger-actuated control valve member disposed within said trigger-actuated control valve housing;

a first valve seat defined upon said lower housing member of said trigger-actuated control valve housing;

a first seal member operatively associated with said first valve seat;

a second valve seat defined upon said upper housing member of said trigger-actuated control valve housing;

a second seal member operatively associated with said second valve seat;

a first bore defined within said upper housing member of said trigger-actuated control valve housing for permitting line pressure to enter said trigger-actuated control valve housing;

a second exhaust bore defined within said lower housing member of said trigger-actuated control valve housing and within which said trigger-actuated control valve member is disposed; and window structure, defined within said trigger-actuated control valve housing, for fluidic communication with a substantially horizontally oriented port defined within a first lower end portion of a substantially vertically oriented air passageway which is defined within the fastener-driving tool housing and which is fluidically connected at a second upper end portion thereof with a control air chamber of the fastener-driving tool, so as to conduct said line pressure to the control air chamber of the fastener-driving tool, from said first bore, said window structure, said substantially horizontally oriented port defined within said first lower end portion of said substantially vertically oriented air passageway, and said substantially vertically oriented air passageway in order to pressurize the control air chamber prior to firing of the fastener-driving tool as a result said first seal member being engaged with said first valve seat while said second seal member is disengaged from said second valve seat, and for permitting fluidic communication from the control air chamber of the fastener-driving tool to said second exhaust bore through said substantially vertically oriented air passageway, said first lower end portion of said substantially vertically oriented air passageway, said substantially horizontally oriented port, said window structure, and said exhaust bore within which said trigger-actuated control valve member is disposed, as a result said second seal member being disengaged from said second valve seat while said first seal member is engaged with said first valve seat, so as to permit firing of the fastener-driving tool.

9. The tool as set forth in claim 8, wherein:

said lower housing member of said trigger-actuated control valve housing has a diametrical extent which is greater than the diametrical extent of said upper housing member of said trigger-actuated control valve housing so that an outer peripheral portion of said lower housing member of said trigger-actuated control valve housing extends radially beyond an outer peripheral portion of said upper housing member of said trigger-actuated control valve housing in order to define a space within which the first lower end portion of the substantially vertically oriented air passageway, and the substantially horizontally oriented port defined within the first lower end portion of the substantially vertically oriented air passageway, can be accommodated.

10. The tool as set forth in claim 8, wherein:

said lower housing member of said trigger-actuated control valve housing is disposed in an eccentric manner with respect to said upper housing member of said trigger-actuated control valve housing.

11. The tool as set forth in claim 8, wherein:

said first and second connectors for disengageably securing said upper and lower control valve housing members together comprise bayonet-type connectors.

12. The tool as set forth in claim 11, wherein said bayonet-type connectors comprise:

a ledge member formed upon said upper control valve housing member; and a pair of diametrically opposed radially outwardly extending lugs disposed upon said lower control valve housing member for engaging said ledge member of said upper control valve housing member.

13. The tool as set forth in claim 12, further comprising:

a pair of diametrically opposed radially outwardly extending cutouts, defined within said ledge member of said upper control valve housing member, for receiving said pair of diametrically opposed radially outwardly extending lugs of said lower control valve housing member and for permitting said upper and lower control valve housing members to subsequently be rotated a predetermined amount with respect to each other whereby said pair of diametrically opposed radially outwardly projecting lugs of said lower control valve housing member can engage said ledge member of said upper control valve housing member so as to disengageably secure said upper and lower control valve housing members together.

14. The tool as set forth in claim 12, wherein:

said ledge member is formed upon a lower peripheral edge portion of said upper control valve housing member; and said pair of diametrically opposed radially outwardly extending lugs are disposed upon upper surface portions of said lower control valve housing member.

* * * * *